US005503050A

United States Patent [19]

Stoev et al.

[11] Patent Number: 5,503,050

[45] Date of Patent: Apr. 2, 1996

[54] FORCE TRANSFERRING SYSTEM FOR A FASTENER

[76] Inventors: Stoyan V. Stoev; Cvetan Strsenoski, both of 5133 W. 22nd Pl., Chicago, Ill. 60650

[21] Appl. No.: 404,263

[22] Filed: Mar. 13, 1995

Related U.S. Application Data

[63] Continuation-in-part of Ser. No. 142,726, Oct. 26, 1993, abandoned.

[51] Int. Cl.[6] ..... B25B 21/00

[52] U.S. Cl. ..... 81/466; 81/177.5; 81/177.85

[58] Field of Search ..... 81/463, 465, 466, 81/177.5, 177.85

[56] References Cited

U.S. PATENT DOCUMENTS 3,158,050 11/1964 Shandel ..... 87/466 X 4,628,776 12/1986 Witbeck ..... 87/466

4,759,242 7/1988 Andersson ..... 87/466

FOREIGN PATENT DOCUMENTS 648559 12/1928 France ..... 87/177.5

*Primary Examiner*—James G. Smith

*Attorney, Agent, or Firm*—Wood, Phillips, Van Santen, Clark & Mortimer

[57] ABSTRACT

A system for transferring a first linear force to a rotational force and a second linear force for rotation of a fastener includes a Y-shaped transferor capable of transferring the first linear force into the rotational force and the second linear force. Preferably, the first linear force is transferred simultaneously to the rotational force and the second linear force. A striker is used to generate the first linear force by striking a V-shaped wing of the Y-shaped transferor.

11 Claims, 3 Drawing Sheets

FORCE TRANSFERRING SYSTEM FOR A FASTENER

CROSS-REFERENCE TO RELATED APPLICATION

This is a continuation-in-part of U.S. patent application No. 08/142,726 filed on Oct. 26, 1993, abandoned.

TECHNICAL FIELD

This invention generally relates to a system for transferring a force applied to a fastener. More particularly, the invention relates to a system that transfers a first linear force into a rotational force and a second linear force to rotate a fastener.

BACKGROUND OF THE INVENTION

Removal of fasteners from a workpiece often becomes an unpleasant and time consuming task when the fastener is held fast and sufficient force cannot be applied to overcome a fastener retaining force (also referred to as a cohesive force) to effect removal. The retaining force is great when the fastener becomes rusted in place, the workpiece or the fastener have expanded or contracted or a power tool, e.g., a hydraulic, pneumatic or electric powered tool, has been used to tighten the fastener.

Penetrating oils are used to dissolve rust to facilitate removal but are not effective if the reason for the great retaining force is not the presence of rust.

Alternatively, the power tool can be used to try to overcome the retaining force. Unfortunately, the power tool does not apply a rotational and linear forces simultaneously to the seat of the fastener. If the rotational force required to overcome the retaining force is greater than the force that the seat can withstand, the power tool strips the seat making removal of the fastener even more difficult.

Hand tools can also be used to remove the fastener; but again only apply a rotational force to the fastener. As with the power tool, if the rotational force required to overcome the retaining force is greater than the force that the seat can withstand, the hand tool will strip the seat rendering removal even more difficult.

With hand tools the force required to overcome the retaining force often cannot be generated without the use of a lever. When the fastener is finally and suddenly freed, the person cannot reduce the force applied to the lever quick enough which results in injury to the person, such as scraped knuckles, which is an unpleasant experience.

The fastener can be struck in an attempt to loosen it. However, immediately after impact, there is no longer any force applied and any beneficial effect of the impact dissipates prior to applying a rotational force.

The action of almost all available tools for tightening and unwinding of threaded fasteners relegates to three cases which we illustrated in FIGS. 1A, 1B and 1C. First, the application of one rotating force vector by a lever with one shoulder (FIG. 1A). Second, the application of a couple of rotating forces by a lever with two shoulders situated vis-a-vis on the center of symmetry of the rigid body (FIG. 1B). Third, the application of resultant vector rotating forces, plus force directed perpendicular down on the seat of the body (FIG. 1C).

In all three cases we have a sum cohesion force that is present and which acts against the rotating forces. Up to the moment of stretching, loosening and unwinding of the fastener, we have equilibrium of a rigid body, i.e., the fastener. The term equilibrium implies that the body is either at rest or its center of mass moves with constant velocity. We shall deal with a body at rest, i.e., a body in static equilibrium.

One necessary condition for equilibrium is that the net force on the body must be zero, and the body must have no tendency to rotate. This second condition of equilibrium requires that the net torque about any origin must be zero. In order to establish whether or not a body is in equilibrium, we must know the size and the shape of the body, and the points of application of the various forces.

The bodies that we discuss here, such as threaded fasteners, are assumed to be rigid. A rigid body is defined as a body that does not deform under the application of external forces. That is, all parts of a rigid body remain at a fixed separation with respect to each other when subjected to external forces. In reality, all bodies will deform to some extent under load condition. Such deformations in some cases are small and will not affect the conditions of equilibrium.

Consider a single force F acting on a rigid body that is pivoted about an axis through the point O as in a FIG. 1A. The effect of the force on the body depends on its point of application. If $\vec{r}$ is the position vector of this point relative O, the torque associated with the force $\vec{F}$ about O is given by:

$$\tau=\vec{r}\times\vec{F}$$

It is well known from the course of physics that the vector is perpendicular to the plane formed by $\vec{r}$ and $\vec{F}$. Furthermore, the sense of $\tau$ is determined by the sense of the rotation that F tends to give to the body. The right-hand rule can be used to determine the direction $\tau$. As can be seen from the FIG. 1A, the tendency of F to make the body rotate about an axis through O depends on the moment arm d (the perpendicular distance to the line of action of the force) as well as on the magnitude of F. By definition:

$$\tau=F\times d$$

Now suppose two equal and opposite forces act in the directions shown in FIG. 1B, such that their lines of action do not pass through the center of mass. Such a pair of forces, acting in this manner form what is called a couple. Since each force produces the same torque, i.e., F×d, the net torque has a magnitude 2×F×d. It is clear, the body will undergo an angular movement about the axis. This is a nonequilibrium situation as far as the rotational motion is concerned. The "unbalanced" or net torque on the body gives rise to an angular acceleration according to the relationship:

$$\tau_{net}=2F\times d-I\times\alpha.$$

In general, a rigid body will be in rotational equilibrium only if its angular acceleration is zero. Since $\tau_{net}-I\times\alpha$, for rotation about a fixed axis, a necessary condition of equilibrium for rigid body is that the net torque about any origin must be zero. So, we have two necessary conditions for equilibrium, which can be stated as follows:

(1) The resultant external force must be zero $\Sigma F=O$ (2) The resultant net torque must be zero about any origin $\Sigma F=O$ $\Sigma\tau=O$ Return to the case of FIG. 1B, we have $F_{rot}+F_{rot}+F_{coh}=O$ to satisfy the conditions for equilibrium, and also $\tau_{net}=O$.

Consider the case of FIG. 1C it is clear that $\Sigma f_i=O$, and $\tau_{net}=O$, but in this case the forces are more in number.

The turning of the body using different tools that are classified in one of the above-described figures is a violation of the conditions of equilibrium, due to the overcoming of cohesive forces $F_{coh}$ by overpowering rotating forces.

In FIG. 1A, the unwinding of a stubborn object can be realized only if $F_{rot}$ becomes greater than $F_{coh}$, so that according the equation $F_{rot}+F_{coh}=O$, it becomes not equal O, and $\tau_{net}\neq O$. This can become true either by increasing the magnitude of $F_{rot}$ or by extending the moment arm d of $F_{rot}$ or by decreasing $F_{coh}$. The respective tool experiences insuperable obstacles, first the increase in $F_{rot}$ is limited, because of limited hand muscles strength, and the increased risk for trauma or broken body if the tool slips. Second, increasing d meets with the limitations of access and requires more free room for applying the tool to, and the turning of, the body, which in most cases is impossible. Decreasing $F_{coh}$ can be accomplished either by using a penetration oil or by stretching and pressing the helixes of the threads of a fastener and the workpiece, which cannot be accomplished with these kinds of tools.

In FIG. 1B, when couple rotating forces are applied, the situation is similar, but every increasing in $F_{rot}$ or d, leads to double increasing of $\tau$ so that tools acting this way have some advantages in comparing with the tools represented by FIG. 1A, if it concerns tight areas.

Now lets analyze the third case, shown on FIG. 1C, where we have equilibrium, so $\Sigma_i f_i+F_{imp}+F_{coh}=O$ where i=1,2, . . . 12 and $\tau_{net}=\Sigma_i f_i \cdot d_i+F_{imp}\cdot x+F_{coh\cdot d=O}$.

If we account that $f_1=f_2=\ldots=f_i$ & $d_1=d_2=\ldots=d_i=d$, then, $\Sigma_i f_i \times d_i=i\times f\times d$.

In this case the overcoming of the equilibrium is much easier, in spite of the fact that f has a smaller amplitude and d is much smaller than in the previous two situations, because we have multiforce action and on the other hand the action of $F_{imp}$, strongly decreases the amplitude of the $F_{coh}$, so unwinding of stubborn objects by these devices are much easier.

U.S. Pat. No. 3,158,050 to Shandel discloses a rotatable impact wrench having a cross arm 2 held in position on a spindle 1 by a spacer sleeve 9. The cross arm 2 is rotated to contact abutment lugs 11 on diametric flange 4 to apply a rotational force to a socket 3 which is placed over a nut. The diametric flange 4 with abutment lugs 11 is not Y-shaped or V-shaped. Further, the cross arm 2 only rotates and cannot provide a linear force because it is held in linear position by the spacer sleeve 9.

U.S. Pat. No. 4,628,776 to Witbeck only provides rotational force and lacks a Y-shaped or V-shaped element.

U.S. Pat. No. 4,759,272 to Andersson is directed to a device in impact wrenches which lacks a Y-shaped or V-shaped element.

French Patent No. 648,559 discloses a U-shaped device in the figures and therefore fails to disclose a Y-shaped or V-shaped element.

Further, there is no teaching in Shandel, Witbeck, Andersson or the French patent of a structure to which a sudden, sharp impact force is applied to remove a fastener.

A system for transferring a linear force to rotational and linear forces that are applied a fastener to cause rotation, and preferably removal, of the fastener which overcomes one or more of these shortcomings is desirable.

SUMMARY OF THE INVENTION

The invention is directed to a system for transferring a linear force to rotational and linear forces that are applied to a fastener. Preferably, the rotation causes removal of the fastener and will be discussed herein as such, it being understood that the transferring system is suitable for use in tightening a fastener.

According to the invention, the transferring system includes a Y-shaped transferor for transferring a first linear force into a rotational force and a second linear force to overcome a fastener retaining force. The rotational and second linear forces are preferably simultaneously applied to the fastener.

The transferring system can also include a striker that provides the first linear force by a sudden sharp impact.

Numerous other advantages and features of the present invention will become readily apparent from the following detailed description of the preferred embodiments and the appended claims.

DETAILED DESCRIPTION OF THE PREFERRED EMBODIMENTS

Although this invention is susceptible to embodiment in many different forms, there are described in detail herein, presently preferred embodiments of the invention. It should be understood, however, that the present disclosure is to be considered as an exemplification of the principles of this invention and is not intended to limit the invention to the embodiments described.

The present invention is to a force transferring system to rotate a fastener. Rotation can either remove or tighten the fastener. The system is very useful in the removal of the fastener and will be discussed as such, it being understood that it is also useful for tightening the fastener.

Figure 1A:
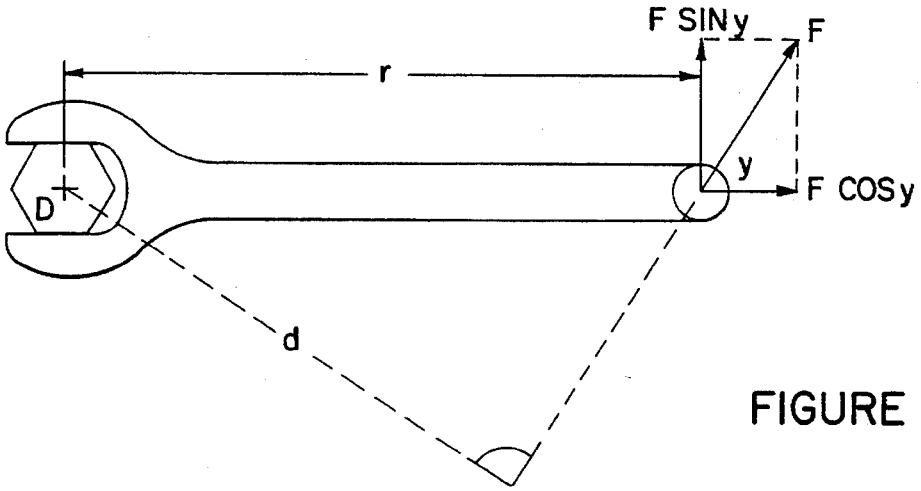
FIGS. 1A, 1B and 1C are schematics illustrating forces applied to a fastener by conventional devices.
Figure 1B:
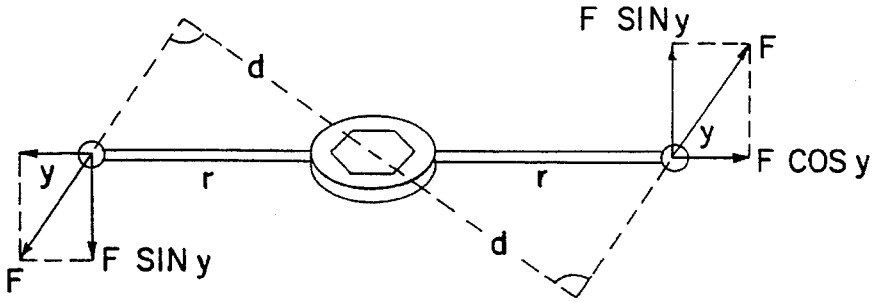
Figure 1C:
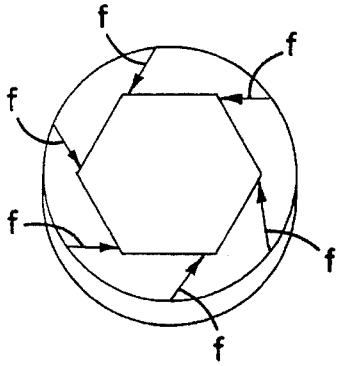
Figure 2:
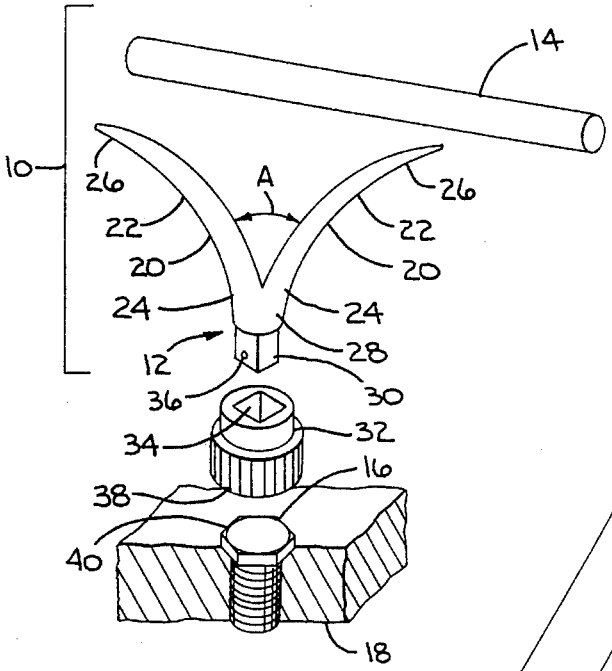
FIG. 2 illustrates a force transferring system of the present invention.

Referring to FIG. 2, a transferring system of the present invention, generally designated 10, includes a Y-shaped transferor 12 for transferring a first linear force imparted by a striker 14 to the Y-shaped transferor 12 to a rotational force and a second linear force on a fastener 16 embedded in a workpiece 18 to overcome a fastener retaining force. The Y-shaped transferor 12 includes a V-shaped wing 20 having two fingers 22. The two fingers 22 include joined first ends 20 and second ends 26. An angle A is formed between the fingers 22. The second ends 26 of the fingers 22 flare slightly outwardly to facilitate striking of the fingers 22 with the striker 14.

A shaft 28 extends from the joined first ends 24 in a direction opposite the direction that the second ends 26 extend and terminates in an adapter 30 that receives a tool 32. Alternatively, the shaft 28 terminates in a tool 32 and lacks an adapter 30. This alternative is not illustrated.

The adapter 30 is capable of receiving various tools 32 in an interchangeable manner to permit the transferring system 10 to be used with numerous types of fasteners. For example, the adapter 32 can be received within an opening 34 of the tool 32. A ball bearing 36 urged outwardly by an internal spring (not shown) partially extends from, but is retained in, the adapter 14. When the adapter 14 is inserted into the opening 34, the ball bearing 36 is pushed into the adaptor 14 and depresses the spring. When the ball bearing 36 aligns with a detent (not shown) or passes over a retaining lip (not shown) within the tool 32, the spring urges the ball bearing 36 outwardly to removably engage the Y-shaped transferor 12 and the tool 32.

The tool 32 includes a head 38 that engages a seat 40 of the fastener 16. The fastener 16 illustrated in FIG. 2 is a threaded bolt wherein the seat 40 is hexagonal. Therefore, the head 38 is an opening that receives the hexagonal seat 40.

Figure 3:
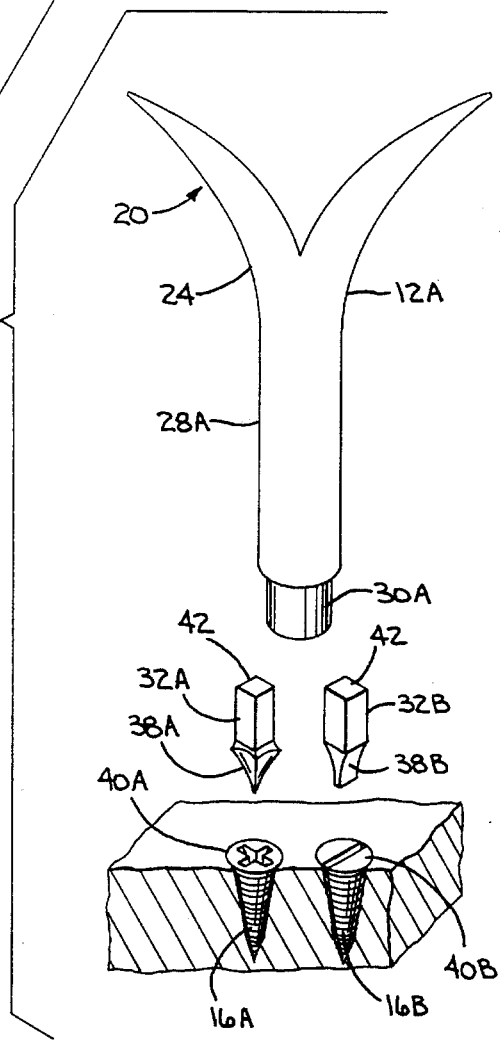
FIG. 3 is another alternative of the transferring system for use with screws.

Referring to FIG. 3, an alternative of the Y-shaped transferor is illustrated as having an integral elongate shaft 28A that extends from the joined first ends 24 of the V-shaped wing 20. The elongate shaft 28A terminates at a distal end, relative to the V-shaped wing 20, in an adapter 30A that receives a post 42 of the tools 32A and 32B. The tools 32A and 32B terminate in screwdriver heads 38A and 38B, respectively. The head 38A is of a phillips screwdriver design that engages a phillips screw seat 40A of the screw fastener 16A. The tool 32B terminates in a regular screwdriver head 38B that mates with a regular screw seat 40B of the conventional screw fastener 16B.

Figure 4A:
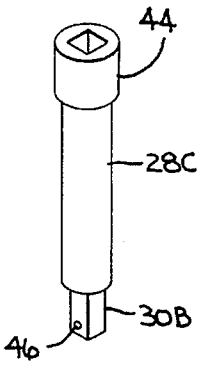
FIG. 4 is an alternative of the transferring system having an elongate shaft.
Figure 4B:
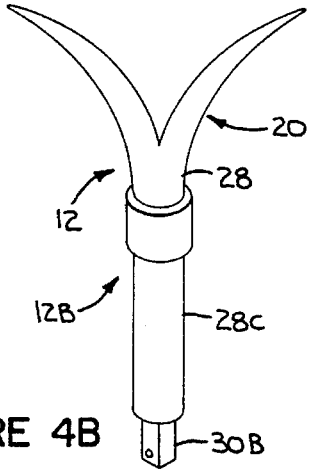

FIGS. 4A and 4B illustrate an alternative of the Y-shaped transferor 12B wherein the elongate shaft 28C is separate with the Y-shaped transferor 12 as opposed to the unitary Y-shaped transferor 12A having the elongate shaft 28A which was discussed above in connection with FIG. 3. The use of the separate elongate shaft 28C permits the length of the shaft 28 of the Y-shaped transferor 12 to be extended as needed which is particularly beneficial in reaching a remote fastener (not shown). The separate shaft 28C has a proximate end 44 that mates with the adapter (not shown) of the Y-shaped transferor 12. A distal end 46 of the separate shaft 28C can terminate in an adapter 30B which mates with the tool (not shown) or, alternatively, it can terminate in the tool (not shown). FIG. 4B illustrates the separate shaft 28C attached to the Y-shaped transferor 12 to make the Y-shaped transferor 12B having a removable separate shaft 28C.

Figure 5:
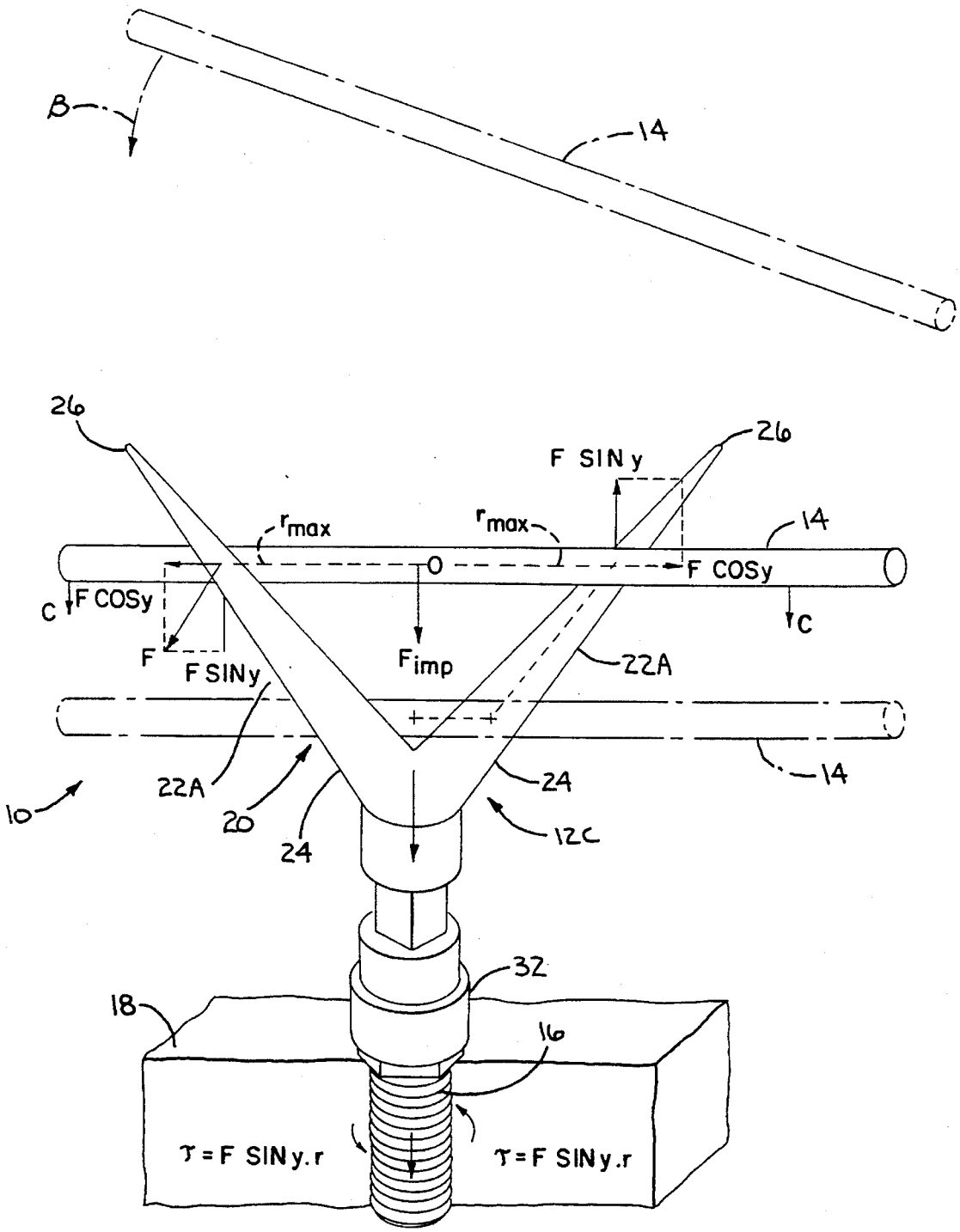
FIG. 5 illustrates the mechanics of, and the forces generated by, the transferring system.

FIG. 5 illustrates the operation of the transferring system 10 and the forces present when the striker 14 impacts the substantially linear fingers 22A, i.e., the second ends 26 are not flared, of the Y-shaped transferor 12C. The striker 14, shown in phantom above the V-shaped wing 20, is brought downwardly in the direction indicated by the phantom arrow "B", to impart a sudden sharp impact to the V-shaped wing 20. The striker 14, shown in solid lines, impacts the V-shaped wing 20 adjacent the second ends 26 of the fingers 22A with a first linear force $F_{imp}$. The striker 14 continuously applies the first linear force $F_{imp}$ as it is guided by the fingers 22A, in the direction indicated by the arrow "C", towards the joined first ends 24 of the fingers 22A where the striker 14, shown in phantom again, comes to rest. Upon impact, the Y-shaped transferor 12 transfers the linear force of $F_{imp}$ into a simultaneous second linear force that stretches the fastener ($F_{str}$) and a rotational force ($F_{rot}$) that is applied in the direction to remove the fastener 16 from the workpiece 18. The striker 14 impacts the fingers 22A as illustrated in FIG. 5 to rotate the fastener 16 counter-clockwise which is the conventional rotation to remove the threaded fastener 16. If the fastener is unconventional and is removed by clockwise rotation, then the striker 14 is swung to impact the fingers 22A on the opposite sides from those shown in FIG. 5.

The transferring system can also be used to tighten a fastener by striking the V-shaped fingers to cause a tightening rotation. This embodiment is not illustrated.

The forces will now be discussed in greater detail. The linear force $F_{imp}$ in a direction parallel to the shaft 28 of the Y-shaped transferor 12C is transferred into the rotational force $F_{rot}$ and the second linear force $F_{str}$. Upon impact of the striker 14 with the fingers 22A, the force is transferred to the Y-shaped transferor 12C but because the fingers 22A are angled, the force $F_{imp}$ is directed against opposite sides of the fingers 22A and the force on each finger 22A is theorized to be defined by the equation:

$$T=F\cdot\sin\phi\cdot r$$

wherein r is one half the distance between the contact points between the striker 14 and each of the fingers 22A. These forces on the fingers 22A are cumulative with the total rotational force (i.e., torque) being defined by the equation:

$$T_{net}=2F\cdot\sin\phi\cdot r$$

The rotational force also varies depending upon the length of the radius so that the maximum rotational force occurs at $r_{max}$ when the striker 14 is nearer to the second ends 26 and the rotational force is the least when the radius is $r_{min}$ when the striker 14 is adjacent the first ends 24. The rotational force becomes O when r=O which occurs when the striker 14 is positioned where the first ends 24 are joined.

The V-shape of the fingers 22A results in the striker 14 being in contact with the fingers 22A along the entire length thereof to transfer the linear force of the striker 14 into the rotational force and second linear force that is applied to the fastener 16.

Preferably, the angle between the fingers of the V-shaped wing are in the range of about 50° to about 70° and more preferably the angle is about 60°.

The rotational system is suitable for use with fasteners that include a seat that a tool of the system can engage. Representative fasteners include regular screws, phillips head screws, specialty screws, nuts, bolts, pins, rivets, and the like. The fasteners are used in motors, machinery, equipment, construction and the like.

It is presently theorized that the simultaneous rotational force and second linear force exerted on the fastener facilitates removal of even stubborn fasteners that are difficult or impossible to remove by applying only a linear force or a rotational force or by sequentially applying a rotational force and a linear force. The V-shaped wing facilitate imparting the forces on the fastener by guiding the striker as it moves along the fingers and providing angled surfaces to which the first linear force can be applied. Guidance is not achieved when, for example, a U-shaped wing is used. Furthermore, a U-shaped wing is only capable of providing a rotational force.

Deformation is theorized to be an important consideration in understanding the mechanism of action of our invention and its advantages over other devices. The linear force deforms the mated fastened and workpiece, e.g., the threads of the fastener and the workpiece, to break bonds therebetween such as those created by oxidation.

The system is particularly well suited for removing threaded fasteners but can also be used to move nonthreaded fasteners that are locked in position. Depending upon which sides of the fingers are struck by the striker, the system can be used to remove right-handed and left-handed threaded fasteners or tighten the same.

The system provides a rotational force and a linear force to a fastener to stretch and loosen the same from a workpiece in which the fastener is held fast.

The system is inexperience and replaces costly power devices. When the system includes the adaptor, existing tools such as sockets can be used with the system.

This invention has been described in terms of specific embodiments set forth in detail. It should be understood, however, that these embodiments are presented by way of illustration only, and that the invention is not necessarily limited thereto. Modifications and variations within the spirit and scope of the claims that follow will be readily apparent from this disclosure, as those skilled in the art will appreciate.

We claim:

1. A system for transferring a linear force to a rotational force and a linear force applied to a fastener, the system comprising:

a Y-shaped transferor for transferring a first linear force to a simultaneous rotational and linear force, the Y-shaped transferor comprising a V-shaped wing, a shaft and at least one of an adaptor for receiving a tool or a tool, the V-shaped wing and the at least one adaptor or tool being at opposed ends of the shaft; and a striker, the V-shaped wing being capable of receiving an impact from the striker.

2. The system of claim 1 wherein the V-shaped wing comprises two fingers each having first and second ends, the first ends being joined, the angle between the fingers being in the range of about 50° to about 70°.

3. The system of claim 2 wherein the angle between the fingers is about 60°.

4. The system of claim 1 wherein the V-shaped wing comprises two fingers each having first and second ends, the first ends being joined, the second ends being outwardly flared.

5. The system of claim 1 wherein the first linear force and the second linear force are in the same direction.

6. An impact operated tool for tightening or loosening a rotary fastener comprising:

a generally Y-shaped tool having a base arm and a pair of fingers connected to the base arm at one end thereof and diverging away from the base arm with an acute angle therebetween; and means at the other end of said base arm defining a fastener engaging surface that is shaped to be complimentary to a tool receiving surface on a fastener to be loosened or tightened.

7. The tool of claim 6 further including a striker bar adapted to be impacted against said tool between said fingers.

8. The tool of claim 6 wherein said means defining a fastener engaging surface is detachably mounted on said base arm other end.

9. The tool of claim 8 wherein said means defining a fastener engaging surface defines a wrench surface.

10. The tool of claim 8 wherein said means defining a fastener engaging surface defines a screwdriver surface.

11. The tool of claim 13 wherein each of said fingers is angled with respect to said base arm and the fingers converge at said acute angle as said base arm one end is approached.

* * * * *